US006588918B1

(12) United States Patent
Millar

(10) Patent No.: US 6,588,918 B1
(45) Date of Patent: Jul. 8, 2003

(54) NON-BATTERY POWERED PORTABLE LAMP

(76) Inventor: Mark A. Millar, 7935 Lea Rd., Bloomington, MN (US) 55438

( * ) Notice: Subject to any disclaimer, the term of this patent is extended or adjusted under 35 U.S.C. 154(b) by 0 days.

(21) Appl. No.: 09/931,999

(22) Filed: Aug. 18, 2001

(51) Int. Cl.[7] ..... F21L 13/00
(52) U.S. Cl. ..... 362/192; 362/208
(58) Field of Search ..... 362/157, 159, 362/171, 192, 193, 205, 208; 310/73

(56) References Cited

U.S. PATENT DOCUMENTS 1,411,616 A * 4/1922 Evans ..... 362/192
1,556,492 A * 10/1925 Coleman ..... 362/192
2,490,309 A 11/1949 Lehman
3,099,402 A 7/1963 Speck
4,315,301 A 2/1982 Jimena
4,332,006 A * 5/1982 Choe ..... 362/193
4,701,835 A 10/1987 Campagnuolo et al.
5,552,973 A 9/1996 Hsu
5,839,817 A 11/1998 Wei
5,880,532 A 3/1999 Stopher
5,905,359 A 5/1999 Jimena

* cited by examiner

*Primary Examiner*—Y. My Quach-Lee

(57) ABSTRACT

A portable non-battery operated lamp has a spring wound up by hand for operation. A releasable lever mounted on the lamp handle swings outwardly and can be rotated to wind up the spring. A rocker switch assembly is moved to an ON position to release the bias of the spring thereby moving a gear train operatively connected to a generator for energizing a LED assembly. The switch can be moved to an OFF position to conserve spring bias prior to full relief of the spring.

19 Claims, 5 Drawing Sheets

NON-BATTERY POWERED PORTABLE LAMP

FIELD OF THE INVENTION

The invention relates to the field of non-battery operated electric lamps, particularly portable lamps or flashlights having a spring wound up by hand operation.

BACKGROUND OF THE INVENTION

Existing hand-powered flashlights have a dynamo which is driven by a wind-up spring motor through a transmission gearing. These flashlights do not have assemblies that function to restrain and conserve spring bias prior to full relief of the spring motor whereby repeated winding up of the spring motor is necessary for continuous operation of the flashlight.

J. Speck in U.S. Pat. No. 3,099,402 discloses a dynamo which feeds electric current to a bulb and charges a storage battery simultaneously. During operation of the dynamo the storage battery is charged whereby after the spring motor has run off, the operation of the flashlight bulb is maintained by the battery. However, use of a battery to supply power to operate the bulb is economically and environmentally undesirable.

SUMMARY OF THE INVENTION

The invention comprises a portable hand-operated utility flashlight having a generally rectangular shaped housing with a top carrying handle. A cranking lever is rotatably mounted on the housing and connected to drive means rotatable to wind up a spring. The spring is connected to a gear train which is connected to a generator. Upon release of spring bias the gear train moves whereby an electrical current is generated by the generator to energize the light-emitting assembly, such as a light-emitting diode. The drive means has a vertical gear having ratchet teeth cooperating with teeth of a vertical gear mate to provide a one-way drive assembly. A center-pivoted lever is moveable into engagement with the vertical gear mate to selectively prevent release of spring bias and thereby conserve spring bias.

DESCRIPTION OF PREFERRED EMBODIMENT

Figure 1:
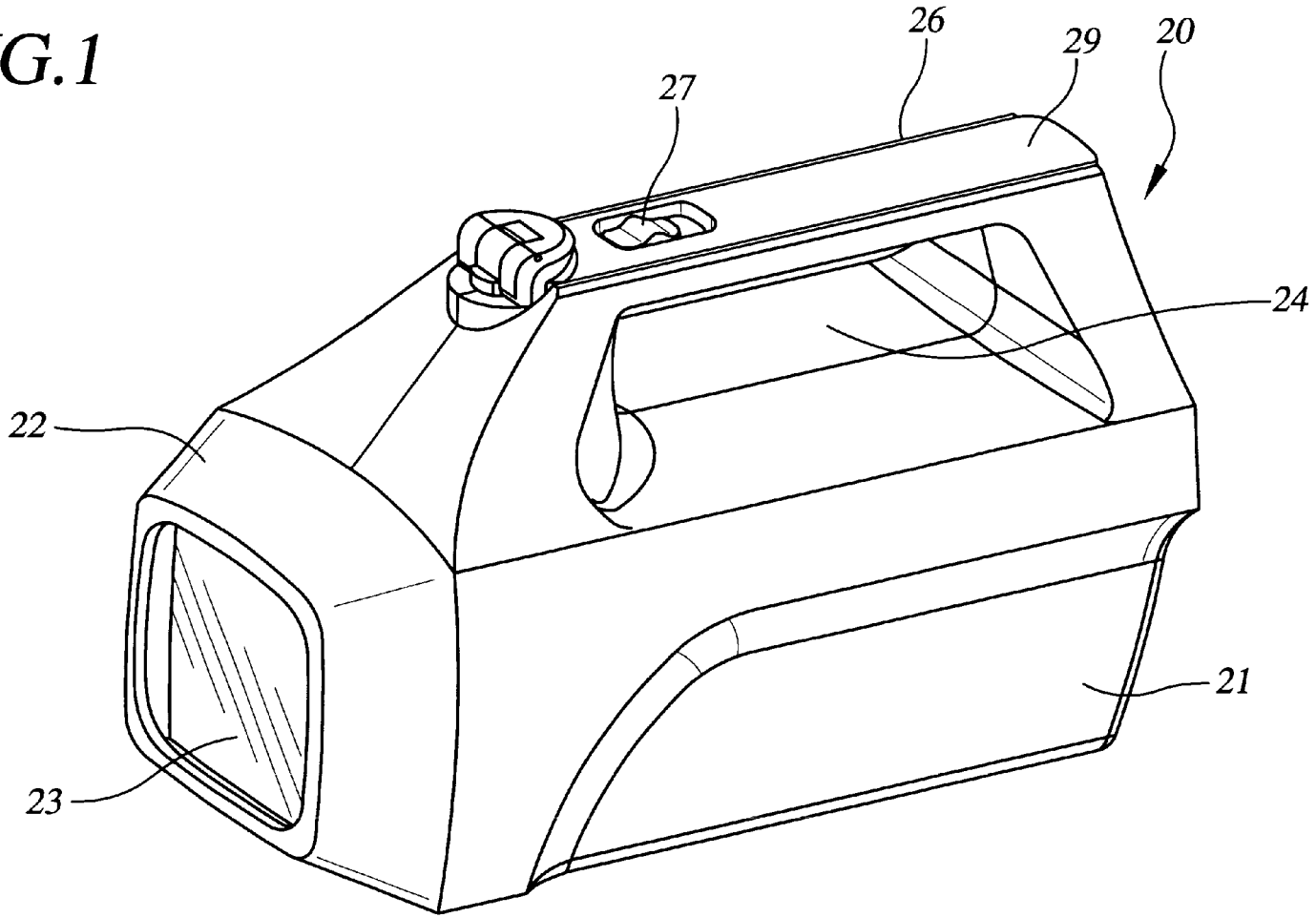
FIG. 1 is a perspective view of the non-battery powered electric lamp of the invention.

Referring to FIG. 1, there is shown a portable non-battery powered electric lamp or flashlight 20 of the invention. Flashlight 20 is a generally rectangular utility-sized portable lamp having a manually activated, wind-up power source, such as a spring motor 66, to power a bulb or light-emitting diode (LED) assembly 67.

Flashlight 20 has a generally rectangular shaped housing 21 having a bezel or front end 22 which accommodates a reflector 92 and a lens 23. The top portion of housing 21 has an opening defining an elongated linear carrying handle 26 adapted to be grasped by the hand of the flashlight user. A thumb switch or tab 27 slidably mounted on the top of handle 26 is moveable between ON and OFF positions to selectively release or conserve spring bias thereby operating as an ON-OFF switch for LED assembly 67. Tab 27 has a friction fit with handle 26 to hold tab 27 in the ON and OFF positions.

Figure 4:
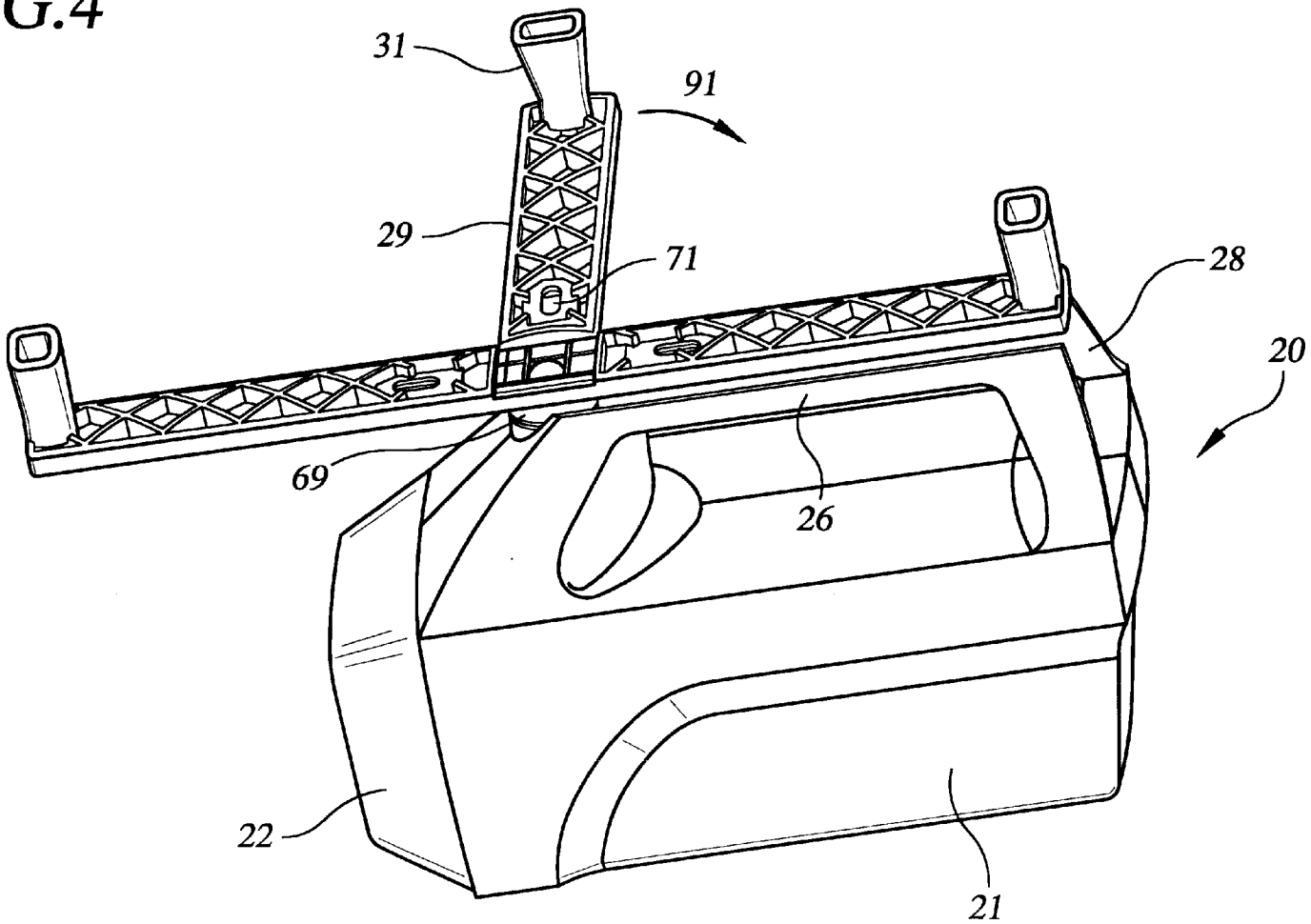
FIG. 4 is a perspective view similar to FIG. 1 showing the lever in the winding position.

Handle 26 has a longitudinal groove 28 accommodating a cranking lever 29 having a hand grip 31 adapted to be rotated by the user to wind up spring motor 66. A rotatably mounted drive shaft 32 is coupled to the inner end of cranking lever 29. Lever 29 is pivotally connected to the top of drive shaft 32 so that lever 29 can be pivoted outwardly from handle enabling the user to rotate lever 29 and wind up spring motor 66. The top of drive shaft 32 has an outwardly projecting connector 34 slidably accommodated by a slot 68 in the inner end of lever 29. Lever 29 pivots on connector 34 to move lever 29 to the winding position and the stored position in groove 28. Hand grip 31 fits into a downwardly extending rear portion 30 of groove 28 with a friction fit to releasably hold lever 29 on handle 26. The inner end of lever 29 has an upwardly projecting semi-circular collar 69 to space lever above handle 26 when lever 29 is moved to the winding position, as shown in FIG. 4.

Figure 2:
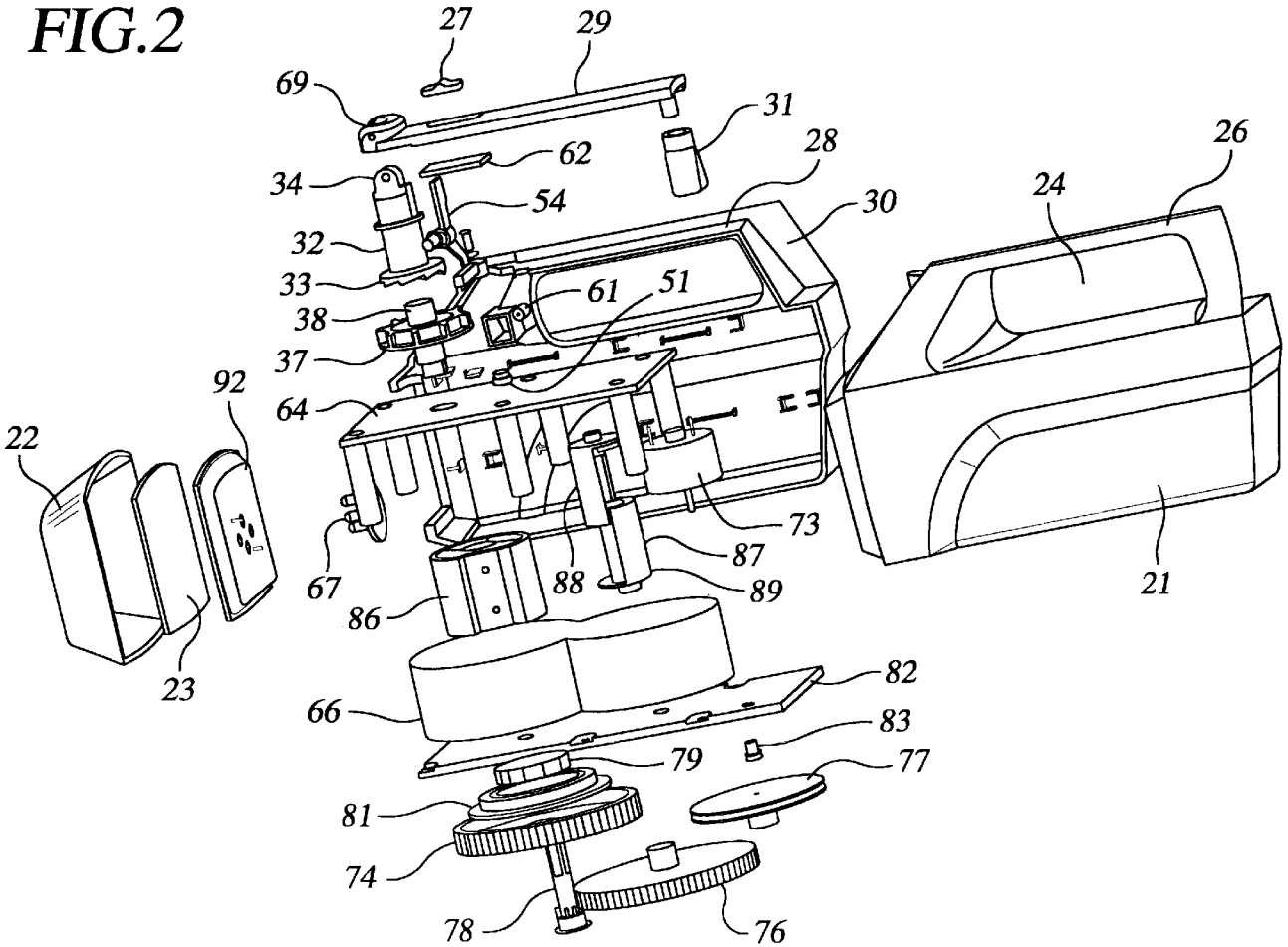
FIG. 2 is an exploded perspective view of the lamp shown in FIG. 1.
Figure 3:
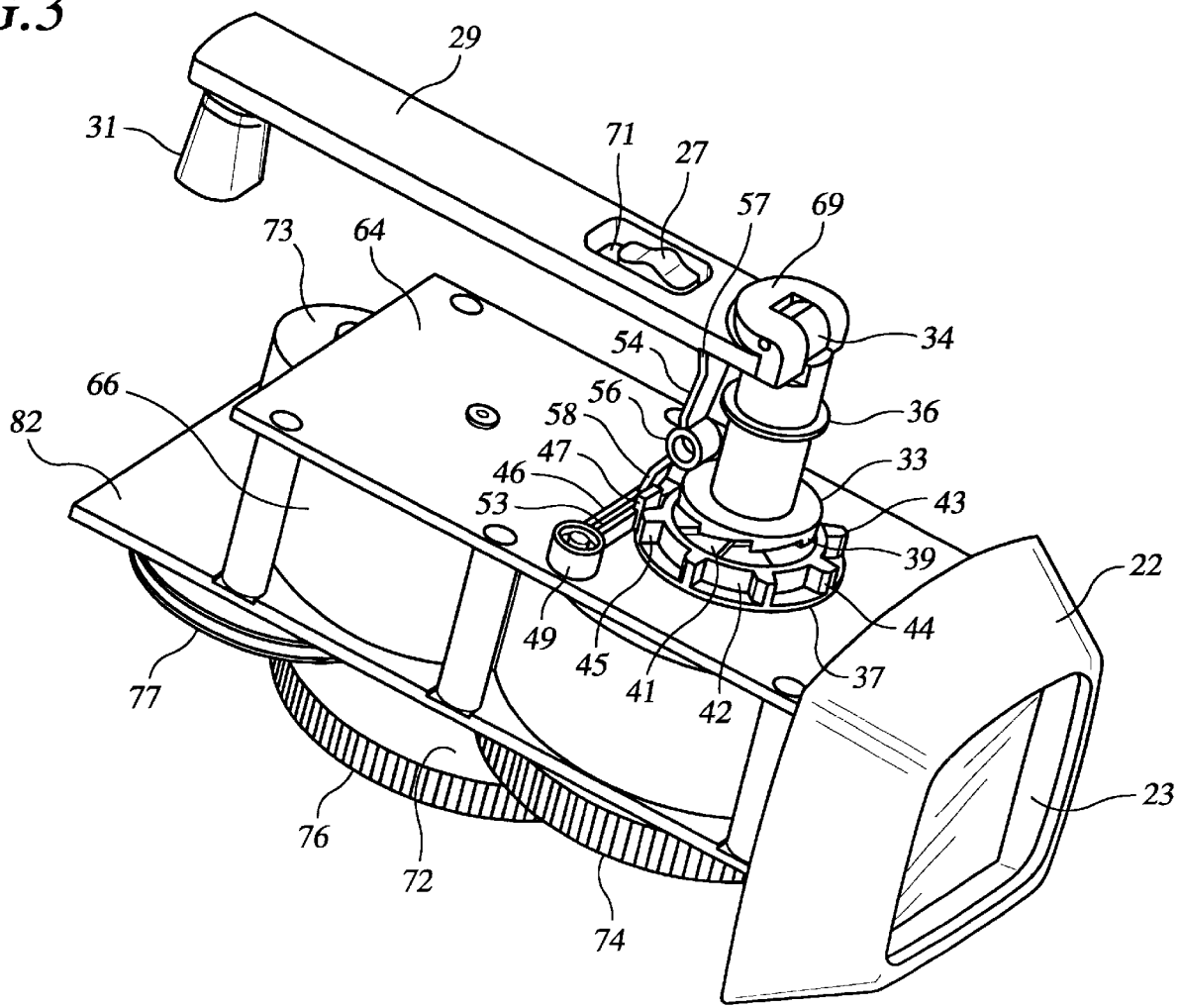
FIG. 3 is a perspective view similar to FIG. 1 showing the lamp with the housing removed therefrom.
Figure 5:
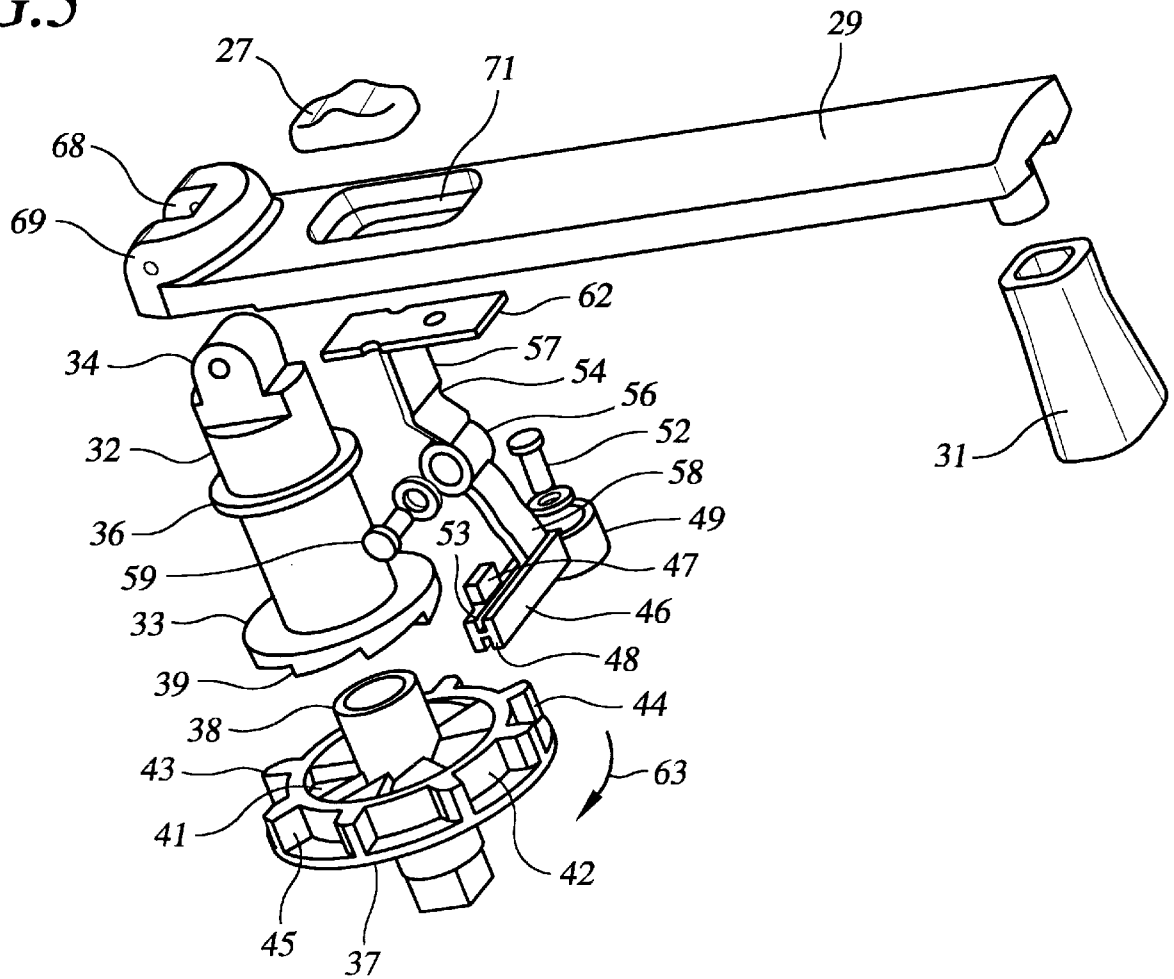
FIG. 5 is an exploded perspective view of the switch and drive assemblies of the lamp shown in FIG. 1.

Referring to FIGS. 2, 3 and 5, the lower end of drive shaft 32 has a vertical gear 33 that meshes with a disc-shaped vertical gear mate 37 surrounding the middle portion of driven shaft 38. Vertical gear 33 is a circular member having ratchet teeth 39 that engage complementary ratchet teeth of vertical gear mate 37 when lever 29 is wound in a clockwise direction. Ratchet teeth 39 and 41 have complementary inclined surfaces that allow counterclockwise motion of vertical gear mate 37 and driven shaft 38. The upper end of driven shaft 38 telescopes into the lower tubular end of drive shaft 32.

Gear mate 37 has an upwardly projecting annular collar 42 located adjacent the outer side surface of gear 33 to stabilize gear 33 and maintain alignment of ratchet teeth 39 and 41. Collar 42 minimizes lateral motion of vertical gear 33 relative to vertical gear mate 37. Gear mate 37 has a plurality of circumferentially spaced fingers 43 which are brought into contact with a locking member 46 to prevent counterclockwise rotation of gear mate 37 thereby conserving spring bias. Fingers 43 project radially from collar 42 to the periphery of gear mate 37. Each finger 43 is a generally rectangular-shaped member having a flat rear surface 45 extended normal to collar 42. Fingers 43 have inclined forward surfaces 44 adapted to slide on a generally flat tongue 47 connected to locking member 46 so that clockwise motion may be imparted to gear mate 37 with cranking lever 29 even when locking member 46 is in the lock position. Tongue 47 has a flat inner surface spaced inwardly from inner side surface of locking member 46 that deflects fingers 43 when locking member 46 is in the lock position and gear mate 37 is driven in a clockwise direction, as indicated by arrow 63 in FIG. 5. Therefore, it is not necessary to first move switch 27 to the ON position prior to winding of spring motor 66.

Locking member 46 is an elongated H-shaped bar member having a generally flat end 48 that engages the rear surface 45 of one of the fingers 43 to prevent counterclockwise rotation of gear mate 37 when locking member 46 is in the lock position. The opposite end of locking member 46 has a circular sleeve 49 that accommodates a boss 51 secured to a top plate 64 on which locking member 46 turns. A pin 52 extended through an opening in boss 51 pivotally mounts locking member on top plate 64 so that locking member can be pivoted from a lock position to a release position or in the opposite manner.

The top of locking member has a linear groove 53. The lower end or arm 58 of a switch lever 54 extends into groove 53. Switch lever 54 controls the pivotal motion of locking member 46. Inward movement of the lower arm 58 of switch lever 54 causes the locking member 46 to move toward collar 42 whereby end 48 is moved into engagement with rear surface 45 of finger 43 stopping counterclockwise rotation of gear mate 37. Conversely, outward movement of lower arm 58 releases end 48 of locking member 46 from rear surface 45 allowing counterclockwise motion of gear mate 37 enabling spring motor 66 to release spring bias. The complementary inclined surfaces of teeth 39 and 41 of gear 33 and gear mate 37 permit counterclockwise motion of gear mate 37.

Referring to FIG. 5, switch lever 54 is a V-shaped member having an upper arm 57 and a lower arm 58 joined to a transverse sleeve 56. Upper arm 57 and lower arm 58 diverge from sleeve 56. Upper arm 57 inclines upwardly and is joined to a generally flat switch back plate 62 connected to thumb switch 27. Thumb switch 27 and plate 62 have a friction fit with handle 26 to hold switch 27 in the ON and OFF positions. Lever 29 has a recessed opening 71 accommodating switch 27. Switch 27 extends through opening 71 whereby thumb switch 27 can be moved to ON and OFF positions when lever 29 is in the stored position.

Lower arm 58 of switch lever 54 inclines downwardly to locking member 46. A pin 59 extended through sleeve 56 pivotally mounts switch lever 54 on a boss 61 projecting from the side of housing 21. The lower end of arm 58 extends into groove 53 in the top of locking member 46. When thumb switch 27 and switch back plate 62 are moved forwardly toward collar 69 to the ON position, upper arm 57 moves forwardly causing switch lever 54 to rock or pivot on pin 59 and move lower arm 58 rearwardly. The rearward movement of lower arm 58 moves locking member 46 away rearwardly from and out of engagement with fingers 43 to release spring bias. Prior to full spring release switch 27 can be moved rearwardly to the OFF position. Upper arm 57 then moves rearwardly pivoting lower arm 58 forwardly and moving locking member 46 forwardly into engagement with fingers 43 to jam or stop counterclockwise motion of gear mate 37 and conserve any remaining spring bias. The inclined surfaces 44 of fingers 43 slide on tongue 47 of locking member 46 so that gear mate can be driven in a counterclockwise direction to wind spring motor 66 when locking member 46 is locating in the stop position. Spring motor 66 can also be wound when locking member 46 is located in the release position, if desired.

Spring motor 66 is associated with a gear train 72 mounted oh a gear plate or bottom plate 82 for driving a generator 73 by which mechanical energy is converted into electrical energy. The electrical current generated by generator 73 is used to energize LED assembly 67 to give off light. When the spring bias has been relieved the movement of gear train terminates and the production of light is stopped. Thumb switch 27 can be moved rearwardly to the OFF position prior to the full relief of spring motor 66 to conserve spring bias for future use.

Gear train 72 has three horizontal gears 74, 76 and 77 operatively connected to generator 73. The first gear 74 is secured to a gear shaft 78 driven by spring motor 66. A ratchet gear 79 located in a hub ratchet 81 connected to first gear 74 has a one-way drive to move gear 74 when ratchet gear 79 is rotating counterclockwise. The complementary inclined surfaces of the teeth of ratchet gear 79 and hub ratchet 81 permit winding of spring motor 66 without driving gear 74. Second gear 76 has a small diameter top portion engaged with the outer circumference of the first gear and a large diameter bottom portion engaged with the outer toothed circumference of third gear 77 which drives a motor gear 83 connected to generator 73.

Referring to FIG. 2, spring motor 66 has a large spool 86 and a small spool 87 having a top member 88 and a bottom member 89. A conventional spring (not shown), such as a pretensioned steel band spring, has one end fixed to the small spool 87 and its opposite end fixed to large spool 86. When large spool 86 is wound by rotating cranking lever 29 in the clockwise direction, as indicated by arrow 91 in FIG. 4, the spring is wound from small spool 87 onto large spool 86 to increase spring bias.

The present disclosure is a preferred embodiment of the non-battery powered portable lamp. It is understood that the non-battery powered portable lamp is not to be limited to the specific materials, constructions and arrangements shown and described. It is understood that changes in parts, materials, arrangement and locations of structures may be made without departing from the invention.

What is claimed is:

1. A portable hand-operated lamp comprising: a housing, a handle having a lever member rotatably mounted on the housing, a spring, the lever member connected to means rotatable to wind the spring when the lever member is wound in a first direction, a gear train connected to the spring, a generator connected to the gear train, light emitting means connected to the generator, and means operable to selectively prevent release of spring bias whereby upon release of spring bias the gear train moves by which an electrical current is generated by the generator to energize the light emitting means, the means operable to selectively prevent release of spring bias including a center-pivoted lever moveable into engagement with the means rotatable to wind the spring.

2. The lamp of claim 1 wherein: the means rotatable to wind the spring includes a vertical gear having ratchet teeth cooperating with teeth of a vertical gear mate.

3. A portable hand-operated lamp comprising: a housing, a handle having a lever member rotatably mounted on the housing, a spring, the lever member connected to means rotatable to wind the spring when the lever member is wound in a first direction, a gear train connected to the spring, a generator connected to the gear train, light emitting means connected to the generator, and means operable to selectively prevent release of spring bias whereby upon release of spring bias the gear train moves by which an electrical current is generated by the generator to energize the light emitting means, the means rotatable to wind the spring including a vertical gear having ratchet teeth cooperating with teeth of a vertical gear mate, the vertical gear mate having at least one radially extending member engaging the means operable to selectively prevent release of spring bias to prevent rotation of the vertical gear mate.

4. A portable hand-operated lamp comprising: a housing, a handle having a lever member rotatably mounted on the housing, a spring, the lever member connected to means rotatable to wind the spring when the lever member is wound in a first direction, a gear train connected to the spring, a generator connected to the gear train, light emitting means connected to the generator, and means operable to selectively prevent release of spring bias whereby upon release of spring bias the gear train moves by which an electrical current is generated by the generator to energize the light emitting means, the lever member being pivotally attached to the means rotatable to wind the spring allowing the lever member to pivot away from the handle to wind up the spring and pivot toward the handle to store the lever member when not used to wind up the spring.

5. A portable hand-operated lamp comprising: a housing, a handle having a lever member rotatably mounted on the housing, a spring, the lever member connected to means rotatable to wind the spring when the lever member is wound in a first direction, a gear train connected to the spring, a generator connected to the gear train, light emitting means connected to the generator, and means operable to selectively prevent release of spring bias whereby upon release of spring bias the gear train moves by which an electrical current is generated by the generator to energize the light emitting means, the handle having a groove accommodating the lever member.

6. The lamp of claim 1 wherein: the light emitting means is a light-emitting diode.

7. A portable hand-operated lamp comprising: a generally rectangular housing having a forward end accommodating light emitting means, a top handle having lever means pivotally mounted on the housing and moveable from a first closed position to a second open position, spring means, the lever means connected to drive means rotatable to wind the spring means, the lever means rotatable to move the drive means and wind the spring means when the lever means is in the second open position, a gear train connected to the spring means, a generator connected to the gear train, the light emitting means connected to the generator whereby upon movement of the gear train the generator generates an electrical current causing the light emitting means to emit light, and switch means having a locking member moveable into engagement with the drive means to selectively prevent release of spring bias and prevent movement of the gear train prior to full relief of spring bias.

8. The lamp of claim 7 wherein: the drive means rotatable to wind the spring includes a vertical gear having ratchet teeth cooperating with teeth of a vertical gear mate.

9. The lamp of claim 8 wherein: the vertical gear mate has an upwardly projecting collar located adjacent the vertical gear to minimize lateral motion of the vertical gear relative to the vertical gear mate.

10. The lamp of claim 7 wherein: the locking member has a first surface deflecting the drive means when the drive means is rotated in a first direction to wind the spring means, and a second surface engaging the drive means to prevent rotation of the drive means in a second direction opposite from the first direction.

11. The lamp of claim 10 wherein: the drive means has at least one radially extending member engaging the second surface of the locking member to prevent rotation of the drive means in the second direction.

12. The lamp of claim 11 including: means releasably holding the lever means on the handle.

13. The lamp of claim 7 wherein: the lever means is pivotally attached to the housing allowing the lever means to pivot away from the handle to wind up the spring and pivot toward the handle to store the lever means when not used to wind up the spring.

14. The lamp of claim 7 wherein: the light emitting means is a light-emitting diode.

15. A method of storing spring bias with a spring coupled to a driven gear, the driven gear being engageable with a locking member and cooperating with a drive gear connected to a lever member mounted on a housing for a gear train connected to a generator for generating an electrical current to energize a light-emitting assembly comprising: pivoting the lever member away from the housing, rotating the lever member to rotate the drive gear and driven gear in a first direction to wind the spring, locating the locking member in engagement with the driven gear to prevent rotation of the driven gear in a second direction to selectively prevent release of spring bias, moving the locking member out of engagement with the driven gear to allow rotation of the driven gear in the second direction thereby selectively releasing spring bias to move gear train by which an electrical current is generated by the generator to energize the light emitting assembly.

16. The method of claim 15 including: permitting rotation of the driven gear in the first direction and prevent rotation of the driven gear in the second direction when the locking member is located in engagement with the driven gear.

17. The method of claim 15 including: deflecting the locking member upon rotation of the driven gear in the first direction.

18. The method of claim 15 including: pivoting the lever member toward the housing to a stored position when the lever member is not used to wind up the spring.

19. The method of claim 18 including: releasably holding the lever member on the housing when the lever member is in the stored position.

* * * * *